US005431391A

United States Patent [19]

Tracey

[11] Patent Number: 5,431,391

[45] Date of Patent: Jul. 11, 1995

[54] GOLFER'S PUTTING AID

[76] Inventor: John D. Tracey, 2703 Clearview, Ottumwa, Iowa 52501

[21] Appl. No.: 271,433

[22] Filed: Jul. 7, 1994

[51] Int. Cl.[6] ..... A63B 69/36; A63B 57/00

[52] U.S. Cl. ..... 273/32 H; 33/508; 33/379

[58] Field of Search ..... 273/32 H, 187.6; 33/379, 387, 388, 389, 390, 508

[56] References Cited

U.S. PATENT DOCUMENTS

| | | | |
|---|---|---|---|
| 1,635,857 | 7/1927 | Murray | 33/379 X |
| 4,174,839 | 11/1979 | Marrs | 273/183 |
| 4,260,151 | 4/1981 | Weaver | 273/32 |
| 4,824,114 | 4/1989 | Catalano | 273/162 |
| 4,927,151 | 5/1990 | Ronnick | 273/32 H X |
| 4,934,706 | 6/1990 | Marshall | 273/32 H X |
| 4,984,791 | 1/1991 | Labell | 273/32 H |
| 5,184,817 | 2/1993 | Kanelous | 273/32 |
| 5,209,470 | 5/1993 | Cimaroli et al. | 273/32 |
| 5,326,096 | 7/1994 | H'Doubler | 273/32 H |

*Primary Examiner*—George J. Marlo

*Attorney, Agent, or Firm*—Zarley, McKee, Thomte, Voorhees & Sease

[57] ABSTRACT

A method for compensating for the slope of a golf green when putting begins with sighting a first line extending from a first point at eye level about two to twelve feet behind a golf ball, over the center of the golf ball, and toward a cup. Then a second line is projected generally downwardly at a first angle with a first plane perpendicular to the green surface and containing the first line, such that the first angle is indicative of the slope of the green surface and the projection of the second line defines a second point on the green surface. The golfer continues by sighting a third line from the second point over the center of the golf ball. In the basic method the golfer completes the process by striking the golf ball along the third line to propel the golf ball toward the cup along a path tangent with the third line. In an extended version of the method, the golfer repeats the projecting and sighting steps at least one more time for greater accuracy. A device for carrying out this method includes a body member having a longitudinal axis, a sight line marked perpendicular to the longitudinal axis on the body member, and a level gauge mounted on the body member perpendicular to the sight line.

9 Claims, 3 Drawing Sheets

76
74
72
70

50
54
20
54
42
26
28
22
24
40
10
46
14
38
12
30
36
34
44
64
68
16
18

50
54
20
54
42
26
28
22
24
40
10
46
14
38
12
52
30
36
34
44
64
68
66
16
18

50
46
54
12
14
16
30
20
56
48
52

5
10
12
14
64
18
68
66
26
22
36
28
24
38
20
46
50
58
54
62
68
66
40
34
42
5

A
B
C
A'
B'
C'
10
22
28
44
50
52
70
72
74
76

GOLFER'S PUTTING AID

BACKGROUND OF THE INVENTION

This invention relates to the game of golf. More particularly, it relates to a device for indicating the slope of the green and a method for compensating for that slope in order to achieve a more accurate putt.

The object of the game of golf is generally to complete each hole (and each round) with the fewest possible number of strokes. During each round, putting on the green accounts for a considerable share of a typical golfer's total strokes. Putting would not be nearly so difficult if the greens were fairly level and the golfer could hit an accurate approach shot. However, the opportunity to reduce one's score by sinking a short putt on level ground is a relatively rare. The reality is that longer putts and/or sloped greens are commonplace on challenging golf courses.

One of the major obstacles to accurate putting is reading the slope of the green. Although some existing devices can measure the slope of the green, none provide explicit directions for compensating for the slope. Once determined, the slope of the green must be compensated for when the putt is lined up. When the green is sloped, the ball must generally be directed uphill of the cup to allow for the uphill to downhill break.

The speed of the golf ball can also affect the degree to which the putt breaks. Generally, the greater the surface speed of the golf ball, the less noticeable the break will be. Therefore, depending on the speed of the ball, there is an array of possible paths for the ball to take in reaching the cup. As professional golfers know, the real trick is to pick a target line and putt the ball along that line with the proper speed to maintain the planned path to the hole.

The present invention is directed at the important step of establishing a target line along which to putt. Golfers often wonder three things about putting: 1) which way will the ball break? 2) how much? and 3) where should the ball be aimed? Assuming that the golf ball is propelled at a moderate or average speed, this invention provides consistent answers to all three questions, whereas the devices of the prior art have fallen short (or left, or right, or long).

By far the most common existing method of reading and compensating for the slope of the green is to kneel at various locations encircling the hole in an attempt to better understand the slope of the green. As might be expected, this method slows the game down. This technique is also substantially ineffective for golfers who are not professionals or more experienced amateurs.

There is a long-felt but unmet need for a device to indicate the slope of a golf green and method for compensating for that slope so that the golfer can putt accurately without spending an unreasonable amount of time. Some devices provide information about the slope of the green, but do not tell the golfer exactly how to compensate for the slope in lining up the putt.

Therefore, it is a primary objective of this invention to provide a device for lining up putts more accurately which represents an improvement over the prior art.

Another objective of this invention is to provide a device for indicating the slope of a golf green and a method for compensating for that slope to improve a golfer's putting game.

Another objective of this invention is to provide a device which is lightweight and compact so that it may be conveniently carried by the golfer during the round of play.

A further objective of this invention is to provide an easy to use device for reading the slope of a golf green and a method of using the same which does not consume an unreasonable amount of time.

A further objective of this invention is to provide a method for indicating the slope of the green that does not rely on walking around the hole.

A further objective of this invention is to provide a device for indicating the slope of the green which is durable in use and easy to manufacture.

These and other objectives will be apparent to one of ordinary skill in the art from the description which follows.

SUMMARY OF THE INVENTION

This invention provides a device and method for indicating and compensating for the slope of a golf green surface during putting.

One embodiment of the device of this invention includes a cylindrical body member which the golfer can hold. A sighting line is marked on the body member perpendicular to its longitudinal axis. The body member houses a level gauge mounted perpendicular to the sighting line. The level gauge itself is conventional in construction and has a bubble for indicating true horizontal and any departure therefrom. The bubble occupies a centered position in the level gauge when the device is held level, and departs proportionally from that position when the device is held at a slope. When the device is pivoted in a vertical plane to bring the bubble back to its centered position over a sloped green surface, the sighting line directs the golfer to stand downhill of the current position and putt on a line extending uphill of the cup. Fold out directing rods may also be added to assist the golfer in clearly distinguishing the projection of the sighting line on the green surface. With the explicit directions provided by this device, the golfer can effectively compensate for the slope of the green and putt more accurately.

A second embodiment of this device has a telescope-like body member which includes an outer sleeve and an inner sleeve. One of the sleeves is telescopically disposed in the other sleeve to allow for more compact storage of the device.

In the method of this invention, the golfer stands behind the golf ball on the green surface and sights a first line from his or her eye over the center of the ball and toward the cup. Then the golfer compensates for the slope of the green surface by centering the bubble within the level gauge and, following the projection of the sighting line, steps to a second point downhill from the first point. The golfer next uses the device to sight over the sighting line to establish a third line which runs through the second point and extends over the center of the golf ball. In the basic method, the golfer can then putt the ball along the third line.

If greater accuracy is desired, the golfer can repeat the slope compensation described above while standing on the second point. Afterwards, the golfer strokes the golf ball along the newly established target line to successfully compensate for the slope of the green and hopefully sink the putt.

BRIEF DESCRIPTION OF THE DRAWINGS

FIG. 6 shows the step of indicating the slope of the green while standing behind the ball so that the ball is in line with the cup.

FIG. 7 shows the step of making an initial compensation for the slope of the green.

FIG. 8 shows the step of making the final compensation for the slope of the green and finding the target point and line on which the ball should be hit at a given speed to sink the putt.

FIG. 9 shows a perspective view of the telescoping eyepiece embodiment of this invention.

FIG. 10 shows a sectional view taken along line 10—10 in FIG. 9.

FIG. 11 is a sectional view taken along line 11—11 of FIG. 10 showing the level gauge and vertical sighting line on the lens piece.

DETAILED DESCRIPTION OF THE PREFERRED EMBODIMENTS

The present invention is a device and method for assisting the golfer during putting. The device helps the golfer read and compensate for the slope of the putting surface when the green is sloped, like in FIG. 1. Even when the green is level, the device assists the golfer by verifying this fact.

Figures 1, 2, 3, 4, 5:
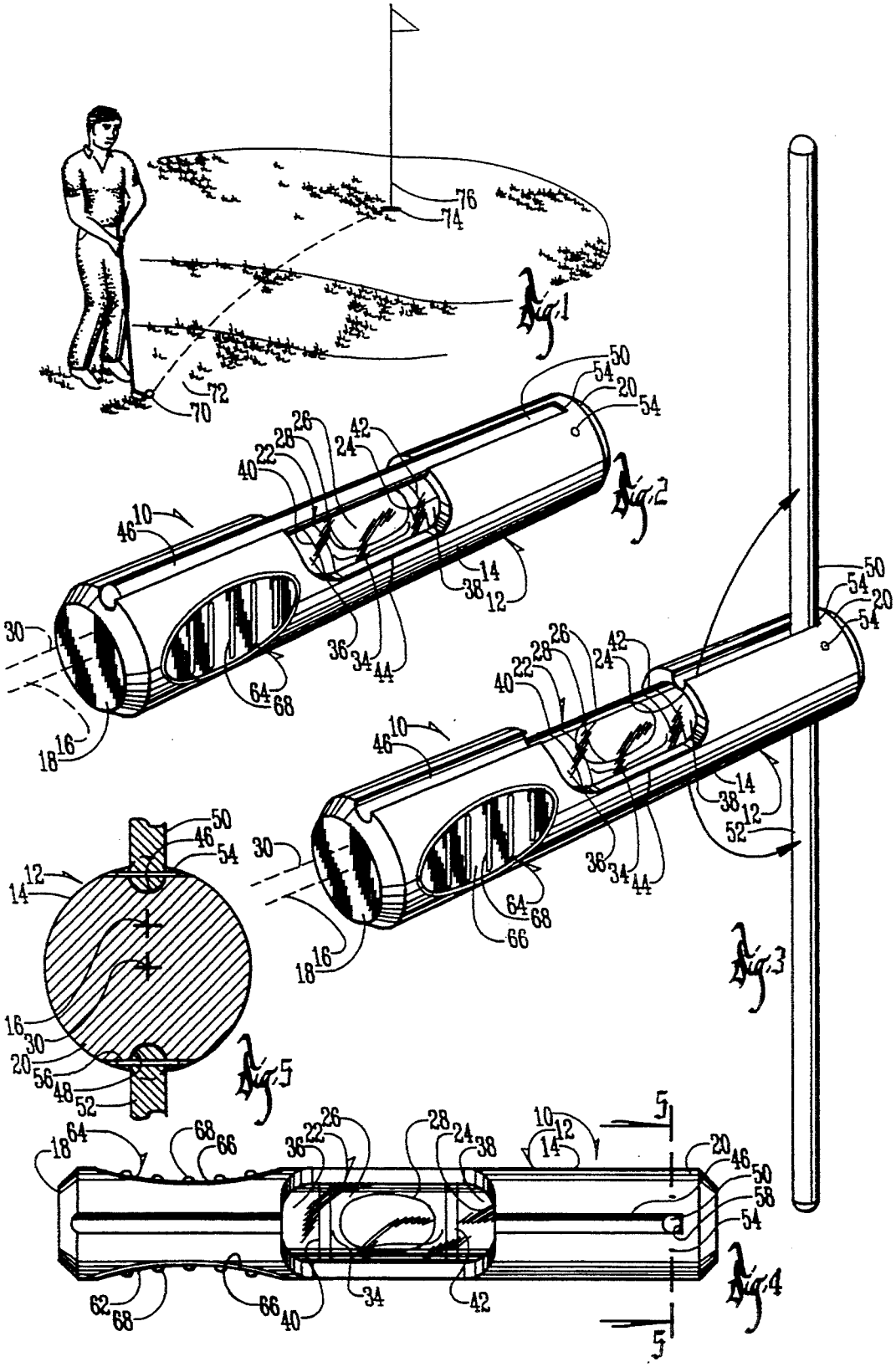
FIG. 1 is a perspective view of a golfer on a sloped green which is the environment in which the present invention is useful.
FIG. 2 is a perspective view of a cylindrical embodiment of the slope measuring and compensating device of this invention.
FIG. 3 is a perspective view of the cylindrical device of FIG. 2 with the directing rods fully extended.
FIG. 4 is a top view of the cylindrical device of FIG. 2.
FIG. 5 is a sectional view taken along line 5—5 in FIG. 4 showing the cylindrical device with the directing rods extended and snapped into place.

One preferred embodiment of the device of this invention is shown in FIGS. 2–5 and is generally designated by the numeral 10. In FIG. 2, a body member 12 has a cylindrical outer surface 14 disposed about a central longitudinal axis 16 and extending between opposite ends 18 and 20. The body member 12 houses a bubble level gauge 22 viewable through an aperture 24 that is centrally disposed between the ends 18 and 20 along in the top of the body member 12. Preferably, the device 10 is small enough to be held by hand and fits easily into the golfer's pocket or golf bag. Alternately, the device 10 can be detachably mounted on one of the golfer's golf clubs.

As best seen in FIG. 4, the bubble level gauge 22 includes a closed ended tube 26 made of glass, plastic or similar transparent material. The bubble level gauge 22 is filled with a liquid to such an extent that only a bubble 28 of gas, such as air, remains in the tube 26. The bubble level gauge 22 is mounted with its longitudinal axis 30 parallel and coplanar with the central longitudinal axis 16 of the body member 12. The tube 26 of the bubble level gauge 22 has a central portion 34 and two end portions 36 and 38, each of which are delimited from the central portion 34 by a pair of parallel indicating marks 40 and 42 marked transversely on the outer diameter of the tube 26. When the device 10 is held level with true horizontal, the bubble 28 will be centered between marks 40 and 42 in the central portion 34, as shown in FIG. 4. When the device 10 is held in an unlevel position, such as when held by a golfer standing upright (perpendicular to the surface) on a sloped green, the bubble 28 will depart from the central portion 34 of the tube 26 seeking whichever end, 36 or 38 is disposed uphill. The degree of departure of bubble 28 from the central portion 34 is proportional to the degree of slope.

As best seen in FIGS. 2 and 3, a sighting mark 44 encircles the lower portion of the body member 12 at the center of the central portion 34 of the bubble gauge 22. In FIG. 5, lengthwise grooves 46 and 48 extend respectively along the top and bottom of the body member 12 and receive directing rods 50 and 52. The directing rods 50 and 52 are pivotally attached to the body member 12 by pins 54 and 56 respectively. In FIG. 2, the directing rods 50 and 52 are shown pivoted downwardly into grooves 46 and 48. In that position, the rods 50 and 52 are preferably flush with the outer surface 14 of the body member 12 so that the device 10 may be compactly stored.

FIG. 3 shows the directing rods 50 and 52 pivoted into fully extended positions. In such positions, rods 50 and 52 contact the rear walls 58 and 60 of grooves 46 and 48 respectively, and are thereby held perpendicular to the longitudinal axis 32 of the body member 12. As a result, the directing rods 50 and 52 are also perpendicular to the longitudinal axis 30 of the bubble level gauge 22, along which the bubble 28 moves. Furthermore, the directing rods 50 and 52 are offset from and parallel to the plane containing the sighting mark 44. When the positions of the pins 54 and 56, the sizes of the rods 50 and 52, and the sizes of the grooves 46 and 48 are coordinated, an interference fit between the pins, rods, and grooves can be established. The interference fit holds each rod locked in its fully extended position until the rod is forcibly folded down by hand.

Preferably, between end 18 and aperture 24, the body member 12 has opposing indentations 62 and 64 therein. A finger grip 66 having a plurality of ribs 68 thereon is disposed on each of the indentations 62 and 64 so that the device 10 may be manipulated between by the golfer's index finger and thumb.

Figures 6, 7, 8:
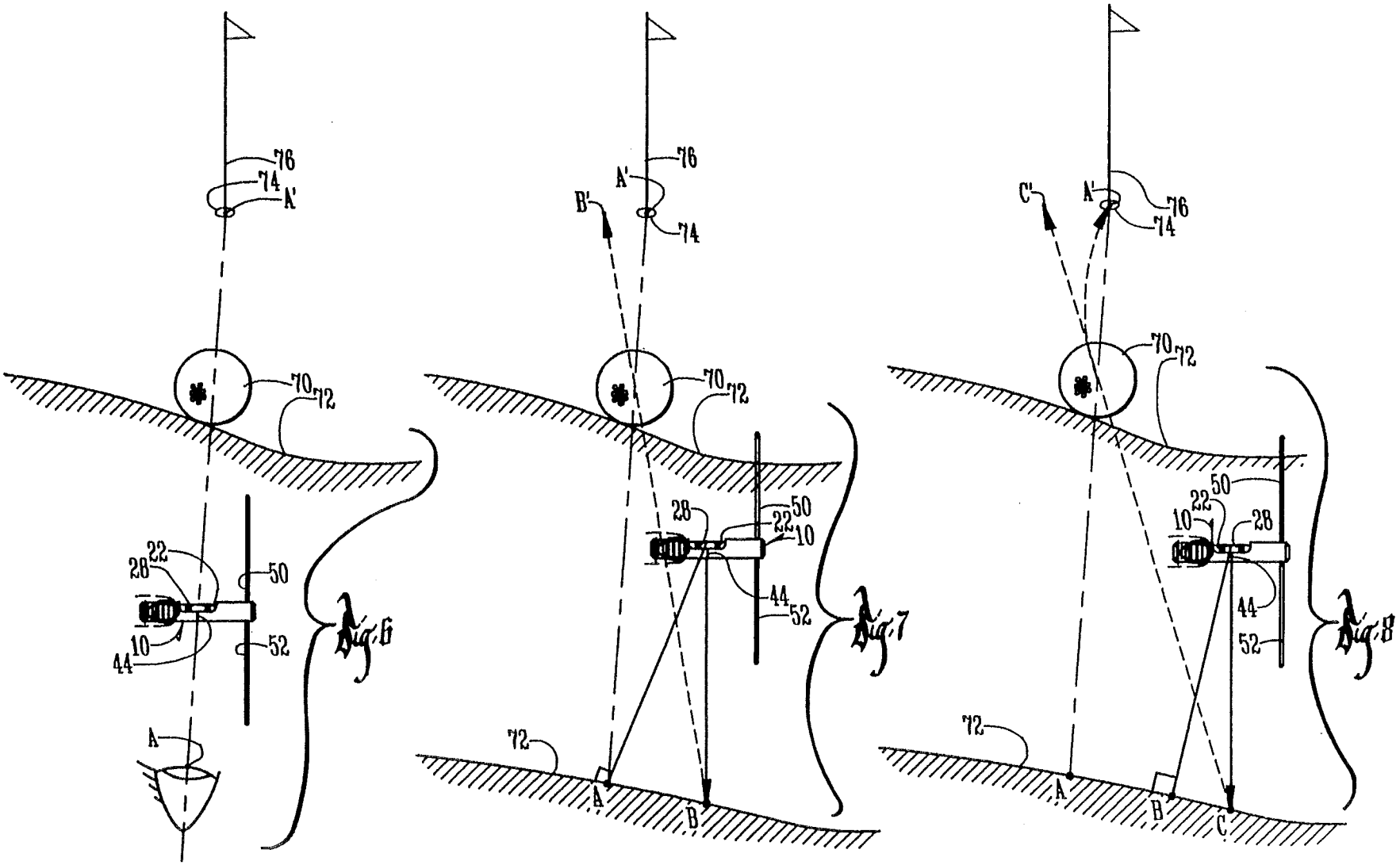
FIGS. 6–8 are diagrammatic views depicting the method of using the device of this invention to indicate and compensate for the slope of the green while lining up a putt.

The use of device 10 is illustrated in FIGS. 6–8. In FIG. 6, a golf ball 70 rests on a sloped green surface 72 some distance away from the cup/hole 74. (The flag 76 has been left in the cup 74 for the purpose of making the hole 74 more visible in the drawings.) In the first step, the golfer stands about five to six feet behind the golf ball 70. This distance allows the golfer to keep the ball and the cup 74 in view at the same time, but keeps the golfer standing fairly close to the ball so that the slope of the green surface 72 underneath the golfer's feet is usually approximately the same as that underneath the golf ball 70.

With the device 10 held between the golfer's thumb and index finger, the golfer sights a straight line A—A' from the golfer's dominant or preferred sighting eye over the sighting mark 44 and the center of the golf ball 70 and the cup 74. Directing rods 50 and 52 are pivoted outwardly into their fully extended positions, wherein they are perpendicular to the longitudinal axis 30 of the bubble level gauge 22. As seen in FIG. 7, when the golfer holds the device 10 parallel to the surface under the golfer's feet, the bubble 28 in the level gauge 22 is not centered between the pairs of central portion indicating marks 40 and 42 if the surface is sloped. However, the golfer pivots the device 10 in a vertical plane so that the bubble 28 is centered between the indicating marks 40 and 42. By doing this, the golfer has actually compensated for the slope of the green surface 72 on which the golfer stands and, effectively, the slope of the green surface 72 where the ball 70 rests.

When the device 10 is pivoted by the golfer such that the bubble 28 is centered, the sighting mark 44 and the lower directing rod 52 will point to a spot B on the ground some distance downhill from the golfer's current position A. Because the directing rods 50 and 52 are much closer to the sighting mark 44 at the center of device 10 than they are to the ground, minimal error is introduced by using the directing rods to point to the appropriate downhill location rather than the sighting mark 44 as shown in FIGS. 6–8. The directing rods 50 and 52 are also much longer than the sighting mark 44, making it easier to follow the directions of the rods for slope compensation.

During the next step, the golfer physically moves to spot B as directed by the sighting mark 44 and lower directing rod 52 so as to make an initial compensation for the slope of the green. In other words, the golfer moves downhill from point A to point B as shown in FIG. 7. If the golfer's right eye is dominant, the right foot will be placed on spot B. If the golfer's left eye is dominant, the left foot will be placed on spot B. From spot B, the golfer sights through the sighting mark 44 and over the center of the golf ball 70 to establish an interim target line B—B'.

At this point, the golfer may choose to address the golf ball 70 in the usual fashion and strike it along the interim target line B—B' in hopes of sinking the putt. This basic method saves time yet still improves putting accuracy considerably, particularly on short putts. However, for most putts, it is preferred that the following additional steps be performed to achieve greater accuracy.

When the basic method is extended, the golfer pivots the device 10 in a vertical plane so as to center the bubble 28 and again compensate for the slope of the green surface 72. As a result of pivoting the device 10, the sighting mark 44 and the lowering directing rod 52 will be pointing downhill from the golfer's current position to a new position denoted as point C in FIG. 8.

The golfer moves his or her dominant foot to point C and sights through the center of golf ball 70. The line C—C', which extends from point C through the center of the golf ball 70, is the target line upon which the golf ball 70 should be struck with the putter to improve the golfer's chances of successfully sinking the putt. Point C' designates the target point for which the golfer may aim. Alternately, the golfer may aim at a different point along line C—C' that is closer to the golf ball 70. The trajectory of a putt having moderate speed is shown by the arcuate dashed line in FIGS. 1 and 8. As predicted, the golf ball 70 breaks downhill or from left to right due to the slope of the green surface 72.

Use of either the basic or extended method of this invention can allow the golfer to sink a higher percentage of putts and leave missed putts closer to the hole.

Figure 9:
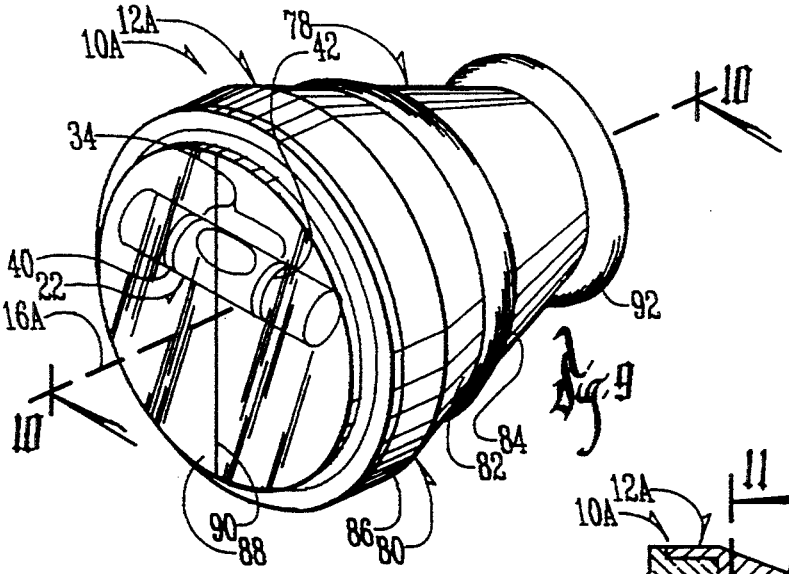
FIGS. 9–11 show an alternate embodiment of the device of this invention in which the level gauge is mounted at the lens piece of a telescoping eyepiece.
Figure 10:
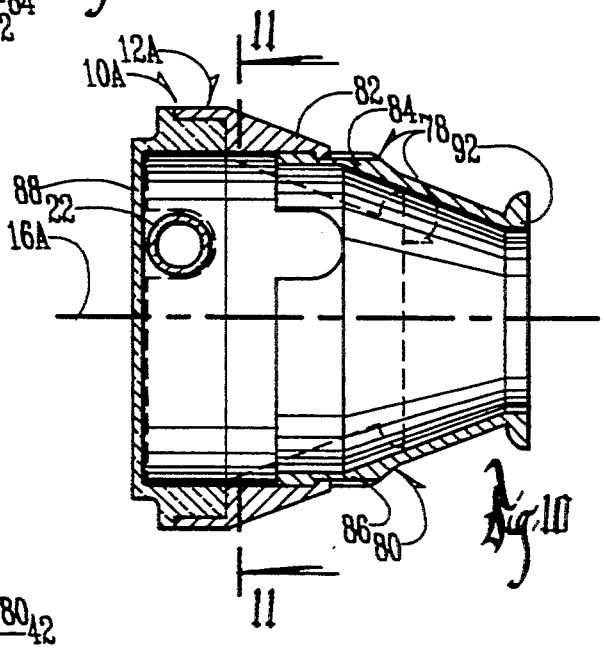
Figure 11:
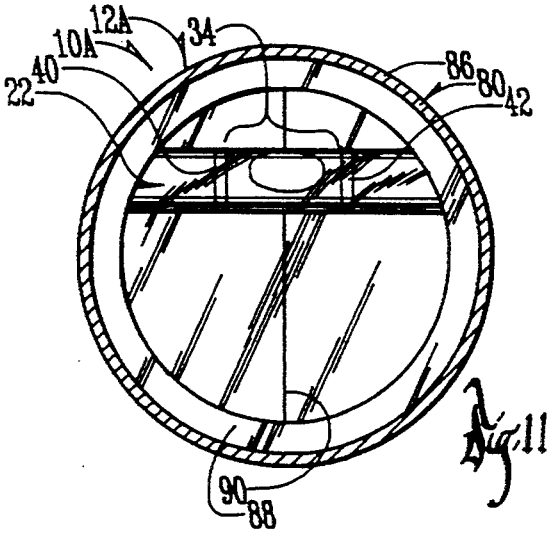

An alternate embodiment of the device of this invention is shown in FIGS. 9–11. The device 10A preferably has a telescoping body member 12A made up of a inner sleeve 78 and an outer sleeve 80 which telescope together to make the device 10A more compact for the golfer to carry. As best seen in FIG. 9, the outer sleeve 80 and inner sleeve 78 are both tapered from one end to the other. In FIG. 10, the smaller end 82 of the outer sleeve 80 accepts and retains the outside of the larger end 84 of the inner sleeve 78. The larger end 86 of the outer sleeve 80 is fitted with a clear lens piece 88. As best seen in FIG. 9, a vertical sighting line 90 is marked in the lens piece 88. A bubble level gauge 22 is mounted adjacent to, or preferably on, the lens piece 88 and perpendicular to the vertical sighting line 90.

As seen in FIG. 11, when the dominate eye of the golfer is directed through the smaller end 92 of the inner sleeve 78, the vertical sighting line 90 and the bubble level gauge 22 appear in the upper portion of lens piece 88 of the device 10A. It is preferred that the bubble level gauge 22 be mounted in the upper portion of lens piece 88 so that the golf ball 70 and the cup 74 can be concurrently viewed in the lower portion.

This telescope-like device 10A works in substantially the same way as the hand held cylindrical device 10, except that no directing rods are used. Instead, the vertical sighting line 90 marked on lens piece 88 serves the same function as the sighting mark 44 and the directing rods 50 and 52. Therefore, the method utilizing the telescope-like device 10A can be briefly described as follows.

While standing with his or her dominant foot at point A, the golfer uses his or her dominant eye and the vertical sighting line 90 to sight over the golf ball 70 toward the cup 74 along line A—A' (FIG. 6). The golfer will then rotate the device 10A so as to center the air bubble 28 between marks 40 and 42 in the central portion 34. When the bubble 28 is centered, the vertical sighting line 90 will no longer be vertical, but will direct the golfer to a point B (see FIG. 7) which is downhill from point A. The golfer's dominant foot will then physically move from point A to point B. At point B, the golfer uses a vertical sighting line 90 to sight over the golf ball 70 in the general direction of the cup 74 along line B—B'. The putt can be struck along line B—B' if the basic method is chosen or further slope compensation can be undertaken in the extended method.

In the extended method, unless the green surface 72 is level at point B, the bubble 28 will not be centered in bubble level gauge 22. The golfer will rotate the device 10A about its central longitudinal axis 16A until the bubble 28 is in a centered position. The vertical sighting line 90 will now direct the golfer to a new downhill position C, as shown in FIG. 8.

Standing with a dominant foot on point C, the golfer uses the vertical sighting line 90 to sight over the golf ball 70 along line C—C' in the general direction of the cup 74. In the extended method, line C—C' is the target line upon which the golfer strokes the golf ball 70. When the ball is propelled along line C—C' at a moderate speed, it will break downhill toward the hole 74 (see curve C-A'). The golfer's chances of sinking putts improves greatly when a key variable, such the slope of the green, is accurately and consistently accounted for with the present invention.

This invention also tells the golfer when the putt will go straight because the green surface is relatively level. A level surface across the green will be indicated by the level gauge. Accordingly, the directed compensations will be negligible. This invention is also useful for pitching, chipping, or any other golf shot in which the slope of the surface plays an important role.

One limitation of this device and method of indicating and compensating for the slope of the green is that only the slope of the green surface 72 near the golf ball 70 gets measured and compensated for. If the green is of different or varying slopes between the golf ball and the cup, these variations cannot be completely accounted for with this method.

Another limitation of the present invention is that it focuses on compensating for the slope of the green, rather than other factors involved in putting. For instance, the speed of the golf ball, how wet or dry the green surface is, the length and grain of the grass on the green, and the wind, all affect how much a given putt will break. The existence of these other factors does not in any way lessen the importance of compensating for the slope of the green as a key ingredient in successful putting.

It should be recognized that the necessary geometric structural relationships involved in the device of this invention are few. Therefore, various sizes and shapes of the device will achieve the stated purposes. For instance, the shape of the device 10 or 10A may be round, square, rectangular, cylindrical, conical, or any other shape, so long as the important relationships between the bubble level gauge and sighting marks (and directing rods when utilized) are maintained.

Whereas the invention has been shown and described in connection with the preferred embodiments whereof, it would be understood that modifications, substitutions, and additions may be made which are within the intended broad scope of the following claims. From the foregoing, it can be seem that the present invention accomplishes at least all of the stated objectives.

What is claimed is:

1. A device for indicating and compensating for the slope of a golf green in lining up a putt, comprising:

an elongated body member for a golfer to hold having opposite ends, an upper portion, a lower portion and an elongated horizontal axis; a level gauge on the upper portion of the body member having an elongated axis parallel to the longitudinal axis of the body member for indicating the slope of a surface under the golfer holding the body member, the level gauge having an indicator member responsive along the elongated axis of the level gauge to the slope of the surface under the golfer and the attitude of the body member; the indicator member having a centered position when the surface is level and departing from the centered position when the surface is sloped; a sight line intersecting the level gauge and extending vertically on the lower portion of the body member perpendicular to the elongated axis of the level gauge;

whereby when the body member having the level gauge mounted thereon is pivoted in a vertical plane to bring the indicator member to the centered position over a sloped surface the sight line directs the golfer to stand in a new position downhill from the original position and the golfer strikes the golf ball from the new position in order to compensate for the slope of the green.

2. The device of claim 1 further comprising an elongated rod protruding from the body member and having opposite first and second ends and a longitudinal axis, the first end being connected to the body member such that the longitudinal axis of the rod extends parallel to the sighting line and perpendicular to the elongated axis of the level gauge whereupon the second end directs the golfer to compensate for the slope of the surface by standing in the new position downhill of the original position.

3. The device of claim 2 wherein the first end of the elongated rod is pivotally connected to the body member whereupon the elongated rod has an open position parallel to the sight line and a closed position wherein the elongated rod is received in a groove on the body member so as to be closed for compact storage of the device.

4. The device of claim 1 wherein the body member has a circular cross section.

5. The device of claim 4 wherein the body member is cylindrical in shape.

6. The device of claim 4 wherein the body member comprises an outer sleeve and an inner sleeve, one of the sleeves being telescopically disposed in the other sleeve so as to form a compact unit for storage when not in use.

7. The device of claim 1 wherein the body member has a lens piece mounted at one of the ends, the level gauge being mounted on the lens piece.

8. The device of claim 5 wherein the body member has a pair of opposing finger grips mounted thereon for the golfer to use in holding the device.

9. The device of claim 1 wherein the level gauge is a bubble level gauge mounted offset from the longitudinal axis of the body member.

* * * * *